US012674303B2

(12) United States Patent
Cook et al.

(10) Patent No.: US 12,674,303 B2
(45) Date of Patent: Jul. 7, 2026

(54) DEBRIS GUARD FOR A LOADER

(71) Applicant: SROOC Holdings, LLC, Waco, TX (US)

(72) Inventors: Jerrod Chance Cook, Lorena, TX (US); Thomas R. Flanary, Jr., Riesel, TX (US); Hugo Gutierrez, Waco, TX (US)

(73) Assignee: SROOC Holdings, LLC, Waco, TX (US)

( * ) Notice: Subject to any disclaimer, the term of this patent is extended or adjusted under 35 U.S.C. 154(b) by 279 days.

(21) Appl. No.: 18/638,644

(22) Filed: Apr. 17, 2024

(65) Prior Publication Data

US 2024/0344298 A1 Oct. 17, 2024

Related U.S. Application Data

(60) Provisional application No. 63/496,586, filed on Apr. 17, 2023.

(51) Int. Cl.
*E02F 3/34* (2006.01)
*E02F 9/22* (2006.01)

(52) U.S. Cl.
CPC ..... *E02F 9/2275* (2013.01); *E02F 3/34* (2013.01); *E02F 3/3414* (2013.01); *E02F 9/2271* (2013.01); *Y10S 414/131* (2013.01)

(58) Field of Classification Search
None
See application file for complete search history.

(56) References Cited

U.S. PATENT DOCUMENTS 12,509,845 B2 * 12/2025 Murai ..... E02F 3/3414

* cited by examiner

*Primary Examiner* — Michael S Lowe
(74) *Attorney, Agent, or Firm* — Michael Scheinberg; Scheinberg & Associates, PC

(57) ABSTRACT

A debris guard assembly comprises one or more flexible portions and one or more rigid portions. The debris guard assembly allows for motion of a moving component, such as, a hydraulic cylinder or a pivot arm, while preventing debris from falling into the cavity around the moving component.

12 Claims, 22 Drawing Sheets

DEBRIS GUARD FOR A LOADER

TECHNICAL FIELD OF THE INVENTION

The present invention relates to a debris guard for a loader.

BACKGROUND OF THE INVENTION

The Kubota SVL 97-2 is a popular track loader. FIG. 1 shows a rear, driver's side portion of a Kubota SVL 97-2 track loader 100 having a hydraulic cylinder 102 from which a hydraulic piston 104 extends. Piston 104 when extended or retracted moves a lifting arm 106, which is connected to a linking arm 108 (FIG. 2) which is pivotally connected to the frame 110 of the Kubota SVL 97-2. FIG. 2 shows a portion of the Kubota SVL 97-2, showing the hydraulic cylinder 102, piston 104, and linking arm 108.

A cover 112 covers a cavity around the hydraulic cylinder 102. To provide for motion of the cylinder, a gap 114 is required in cover 112. Gap 114 allows hydraulic cylinder 102 to pivot as the piston is extended and retracted. Gap 114 opens into a cavity. During operation, the cavity fills with twigs and other debris as can be seen in FIG. 2. A hole lower in the cavity (not visible) allows the debris to fall into the engine compartment, where it can be ignited by a hot engine. Also, the debris can also get compacted by the motion of the hydraulic cylinder 102. The compacted debris can then interfere with the movement of the hydraulic cylinder. A similar gap around linking arm 108 also provides an opportunity for debris to fall into a cavity by linking arm 108.

SUMMARY OF THE INVENTION

An object of the invention is to provide a method and apparatus for preventing debris from entering the region around the hydraulic cylinder of a loader.

A debris guard assembly comprises one or more flexible portions and one or more rigid portions. The debris guard assembly allows for motion of a moving component, such as, a hydraulic cylinder and/or a linking arm, while preventing debris from falling into the cavity around the moving component.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Figure 1:
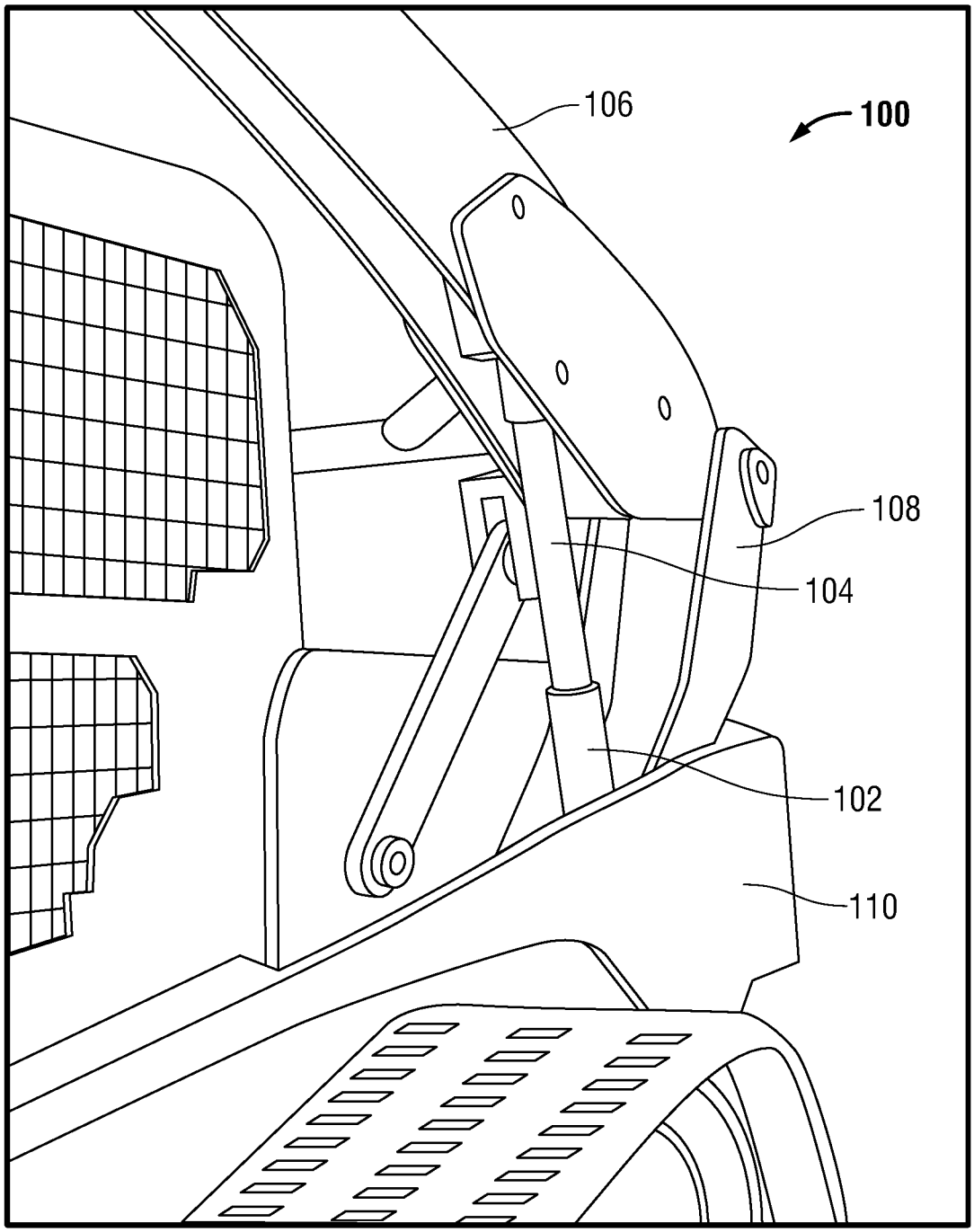
FIG. 1 (Prior art)
FIG. 1 shows a portion of a Kubota SVL 97-2 track loader showing a hydraulic cylinder, piston, linking arm, and a lifting arm.
Figure 2:
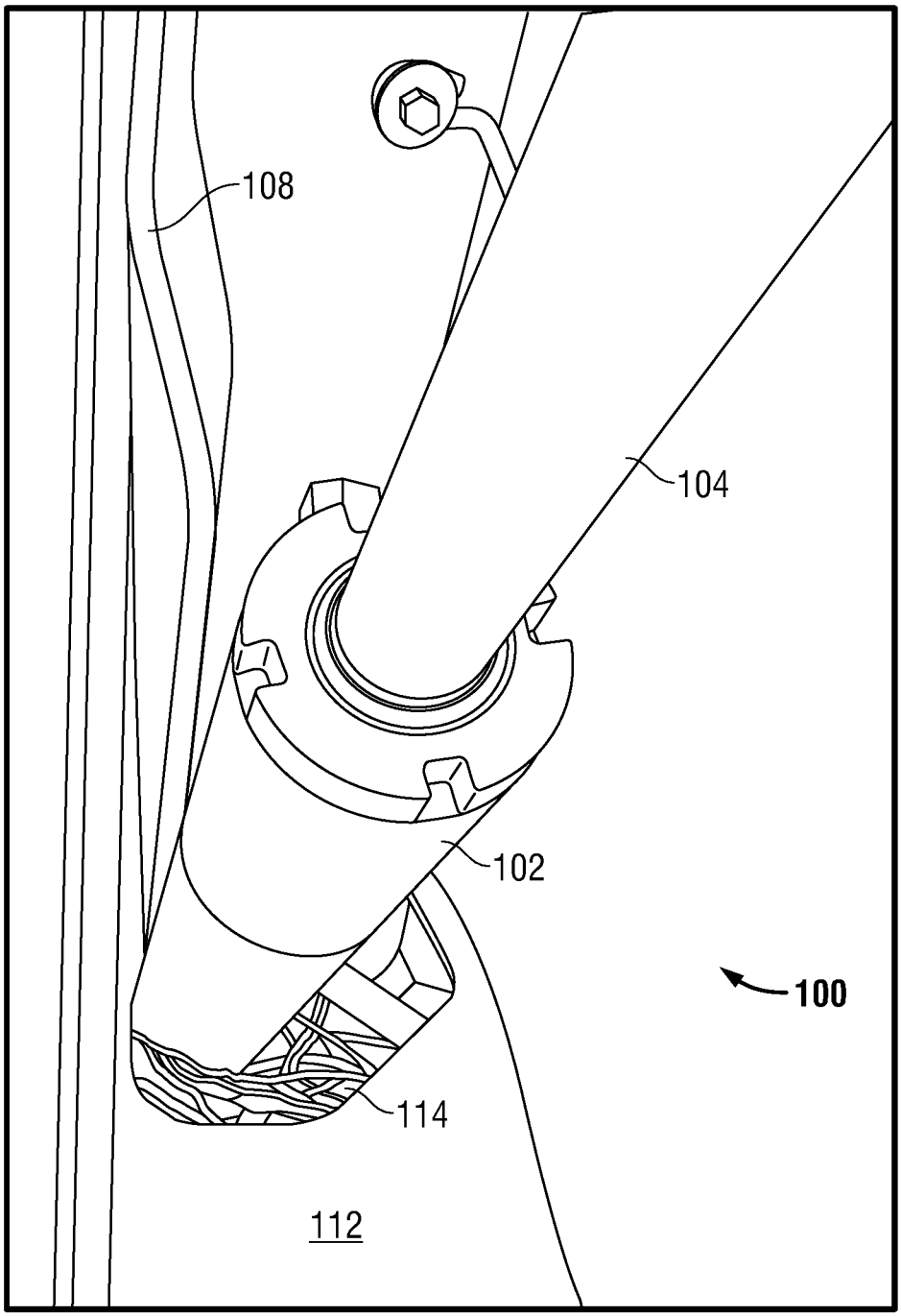
FIG. 2 (Prior art)
FIG. 2 shows a portion of the Kubota SVL 97-2 having a gap in the cover around the hydraulic cylinder.

The description below is specific to a debris guard assembly for a Kubota SVL track loader, although the debris guard assembly can be modified to be applied to other mechanical equipment. As shown in FIG. 2, each side of loader 100 includes two pivoting parts connected to the loader, hydraulic cylinder 102 and linking arm 108, that pivot during loader operation and need to be sealed. Any seal that prevents debris from falling into cavities around those moving parts must allow those parts to pivot freely. The seal described herein includes at least one flexible portion and at least one rigid portion. The flexible portions are preferably composed of rugged, elastomeric material, such as ¼ thick rubber. The rigid parts can be composed of any metal, such as aluminum, steel, or case iron, or other rigid material, such as plastic. The description below will describe a first part that seals around the hydraulic cylinder and a second part that seals around the pivot arm, although such division is merely for convenience and there is overlap between the parts.

While the description herein describes the debris guard on the driver's side of the loader 100, it will be understood that a mirror image seal is used on the passenger side of the loader.

Figure 3:
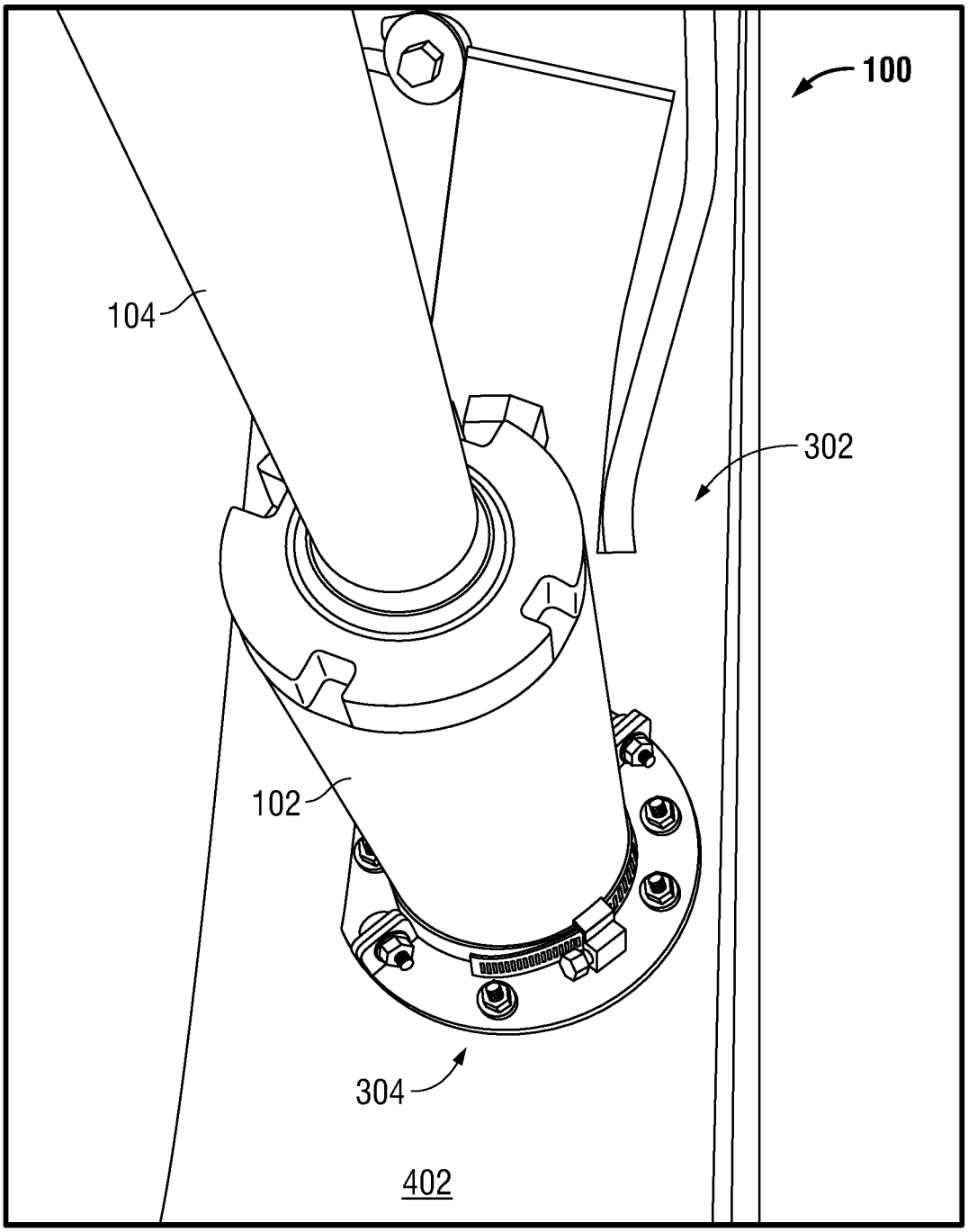
FIG. 3 shows a portion of a debris guard assembly that prevents debris from entering the cavity at the hydraulic cylinder.

FIG. 3 shows a portion of the drivers' side of a loader 100 having a debris shield assembly 302 that prevents debris from entering the cavity around a hydraulic cylinder 102.

Figure 4:
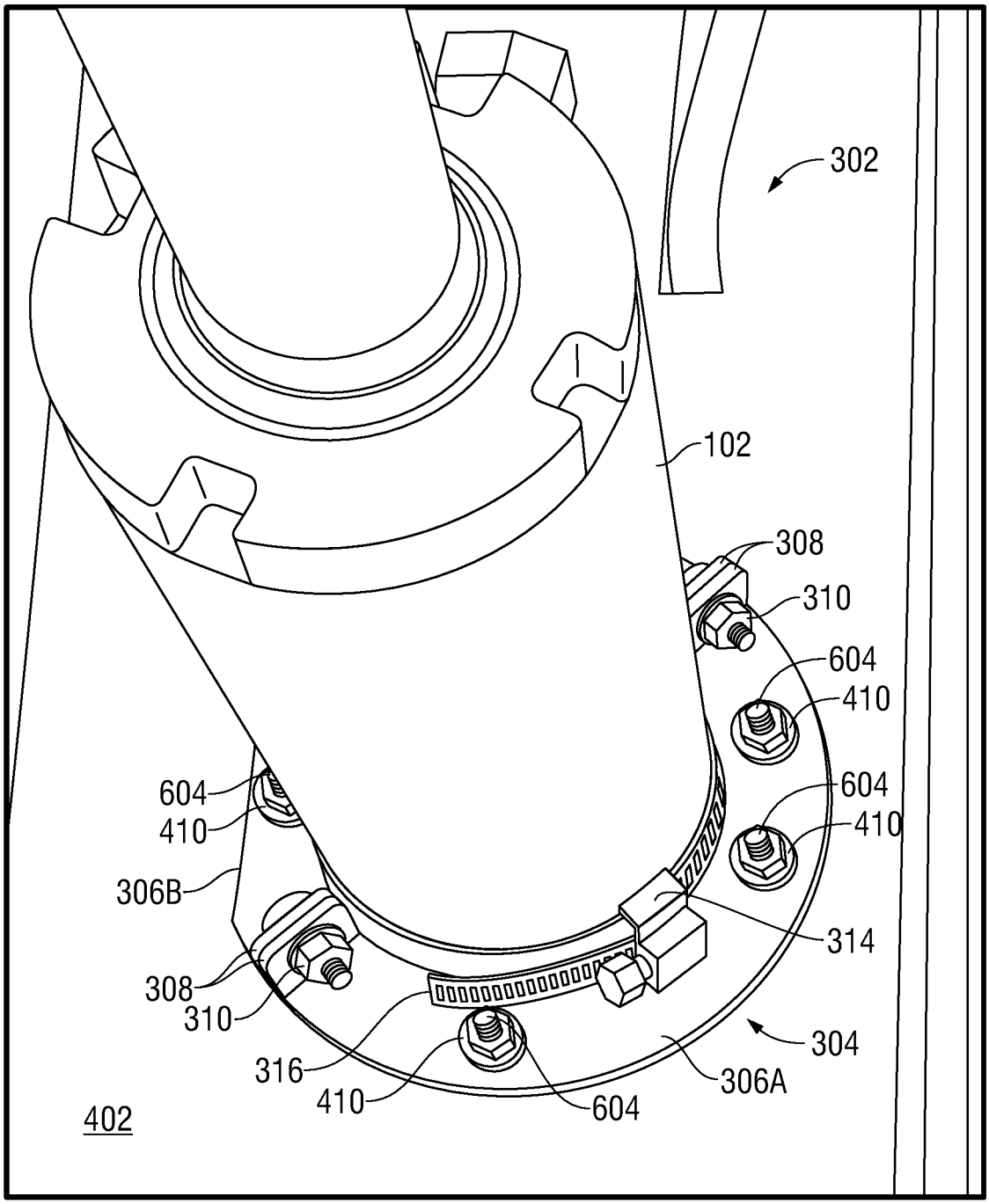
FIG. 4 shows a portion of the debris guard assembly including a clamp assembly around the hydraulic cylinder.

FIG. 4 shows an enlarged view of a portion of the debris shield assembly 302 around hydraulic cylinder 102.

Figure 5:
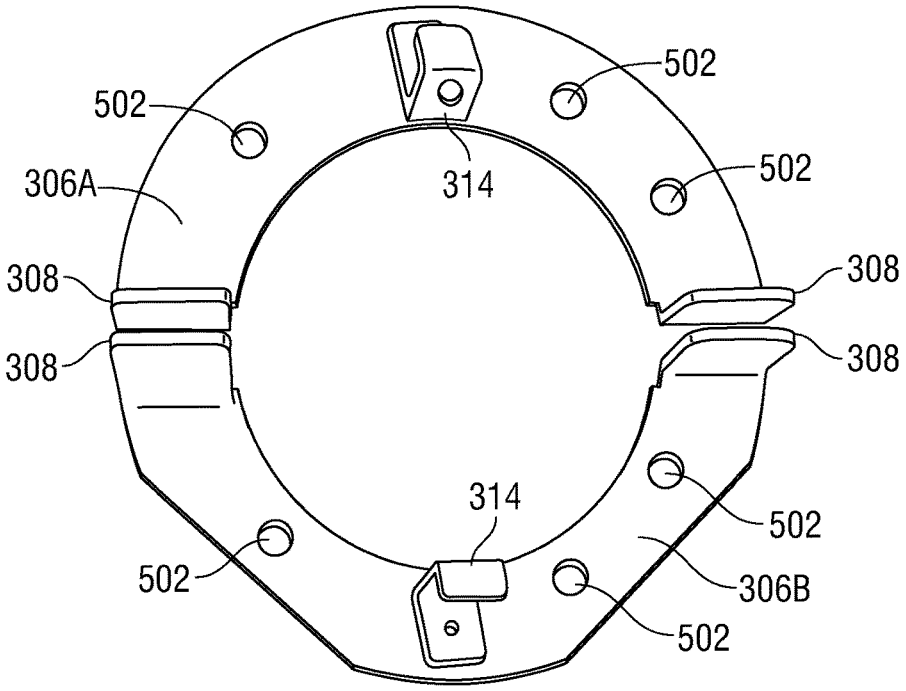
FIG. 5 shows upper parts of the clamp assembly.

As can be seen in FIG. 3, a metal ring assembly 304 surrounds cylinder 102. The metal ring is formed by four sections, two semi-circular sections 306A and 306B (FIG. 5) on top and two semi-circular sections 602A and 602B (FIG. 6) on the bottom, with 602B having a rectangular portion that extends from the semi-circular portion to support rubber sheet 402. FIG. 7 shows an enlarged view of semi-circular sections 306A and 306B. As seen in FIGS. 5 and 7, the two semi-circular sections 306A and 306B each have a lug 308 at either end. Lugs 308 of the two sections are fastened together by a fastener 310, for example, a bolt, nut, and lock washer. A shoulder 314 extends from each of two semi-circular sections 306A and 306B about ½ way along the circumference of between the lugs 308. A hose clamp 316 clamps to hydraulic cylinder 102 below shoulder 314 and maintains the position of metal ring assembly 304 on hydraulic cylinder 102.

Figure 6:
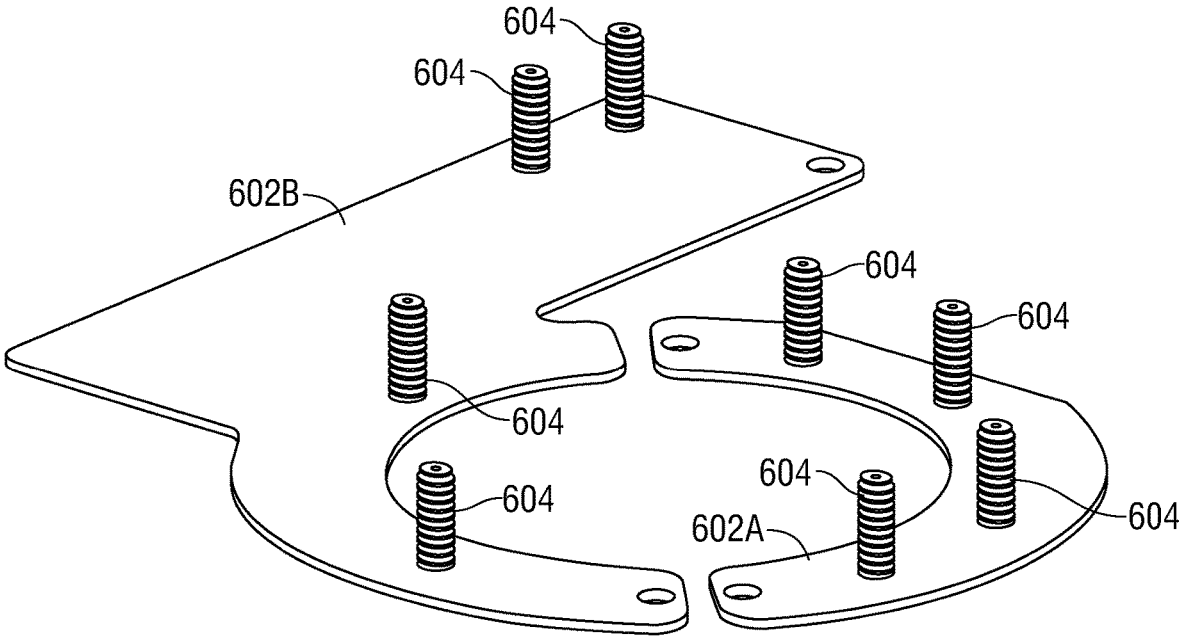
FIG. 6 shows the lower parts of the clamp assembly.
Figure 7:
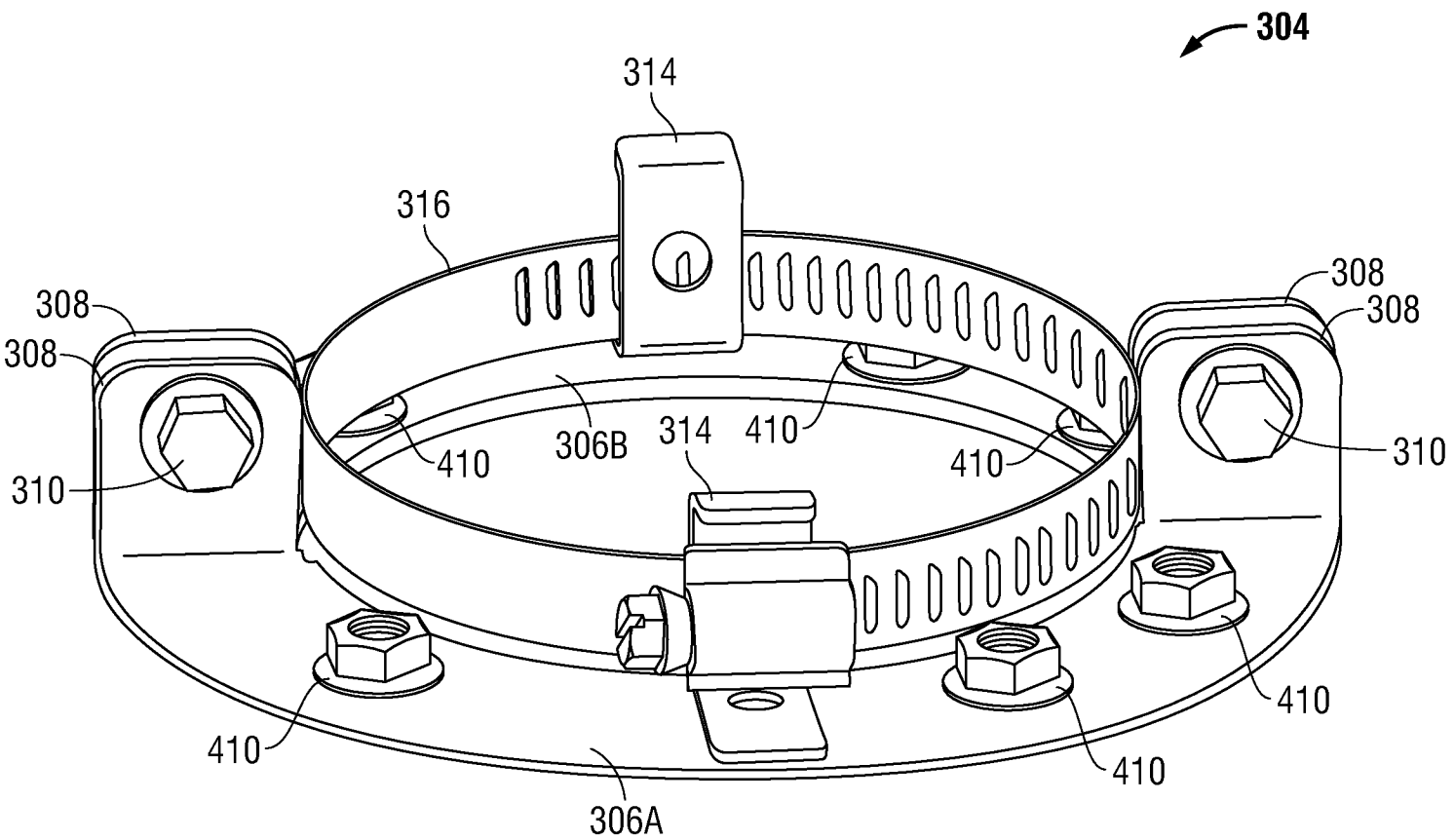
FIG. 7 shows upper parts of an assembled assembly.
Figure 13:
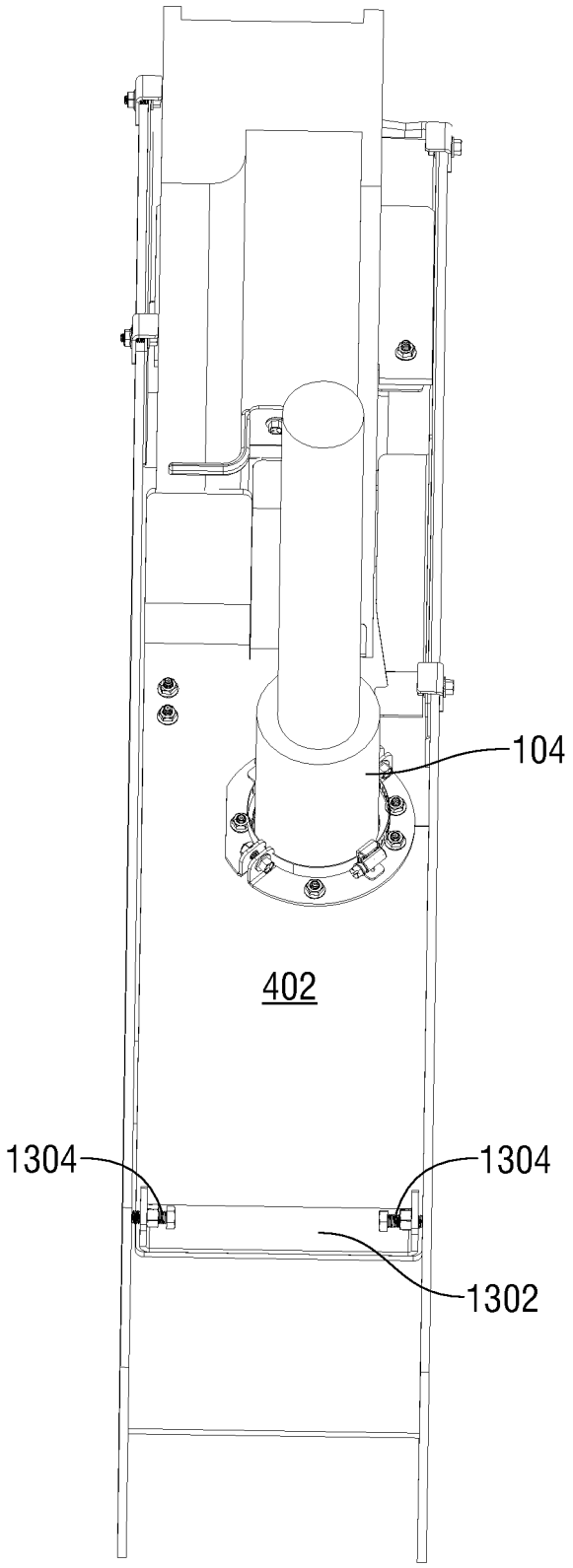
FIG. 13 shows the debris guard assembly image from above.
Figure 14:
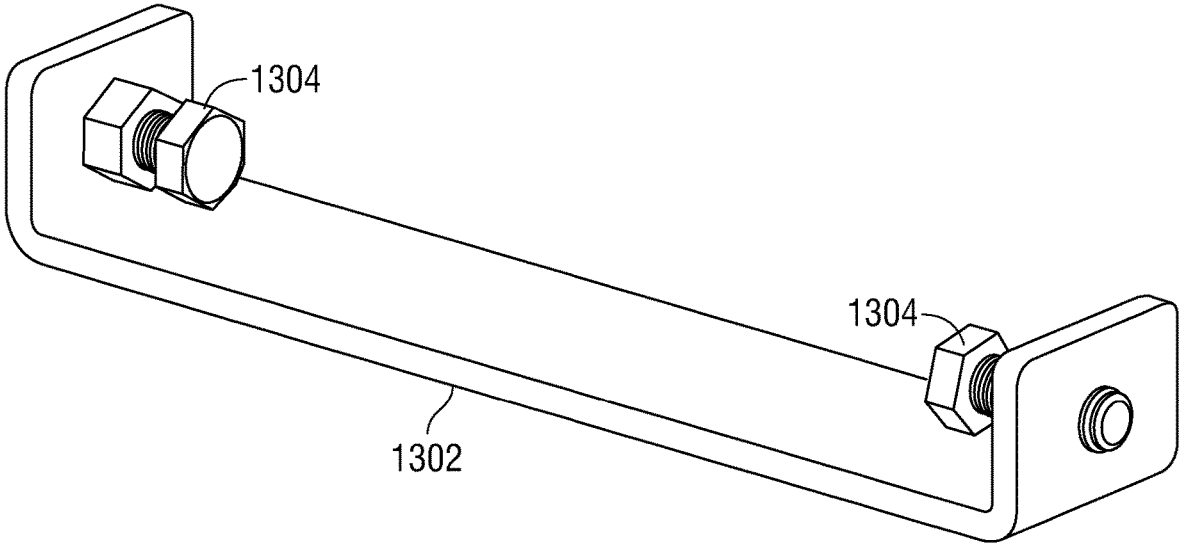
FIG. 14 shows a bracket used to secure a sheet to the loader.

FIG. 6 shows that semicircular sections 602A and 602B include studs 604, which when the debris guard is assembled, pass through holes in rubber sheet 402 and holes 502 in semi-circular sections 306A and 306B. Rubber sheet 402 is formed from a durable, elastomeric materials, preferably about ¼ thick. Rubber sheet 402 is secured to the loader at the front end by bracket 1302. (FIGS. 13 and 14). Nuts 410 screw onto studs 604 to secure rubber sheet 402 between semi-circular sections 306A and 306B and semi-circular sections 602A and 602B. Rubber sheet 402 includes a hole for hydraulic cylinder 102.

Figure 8:
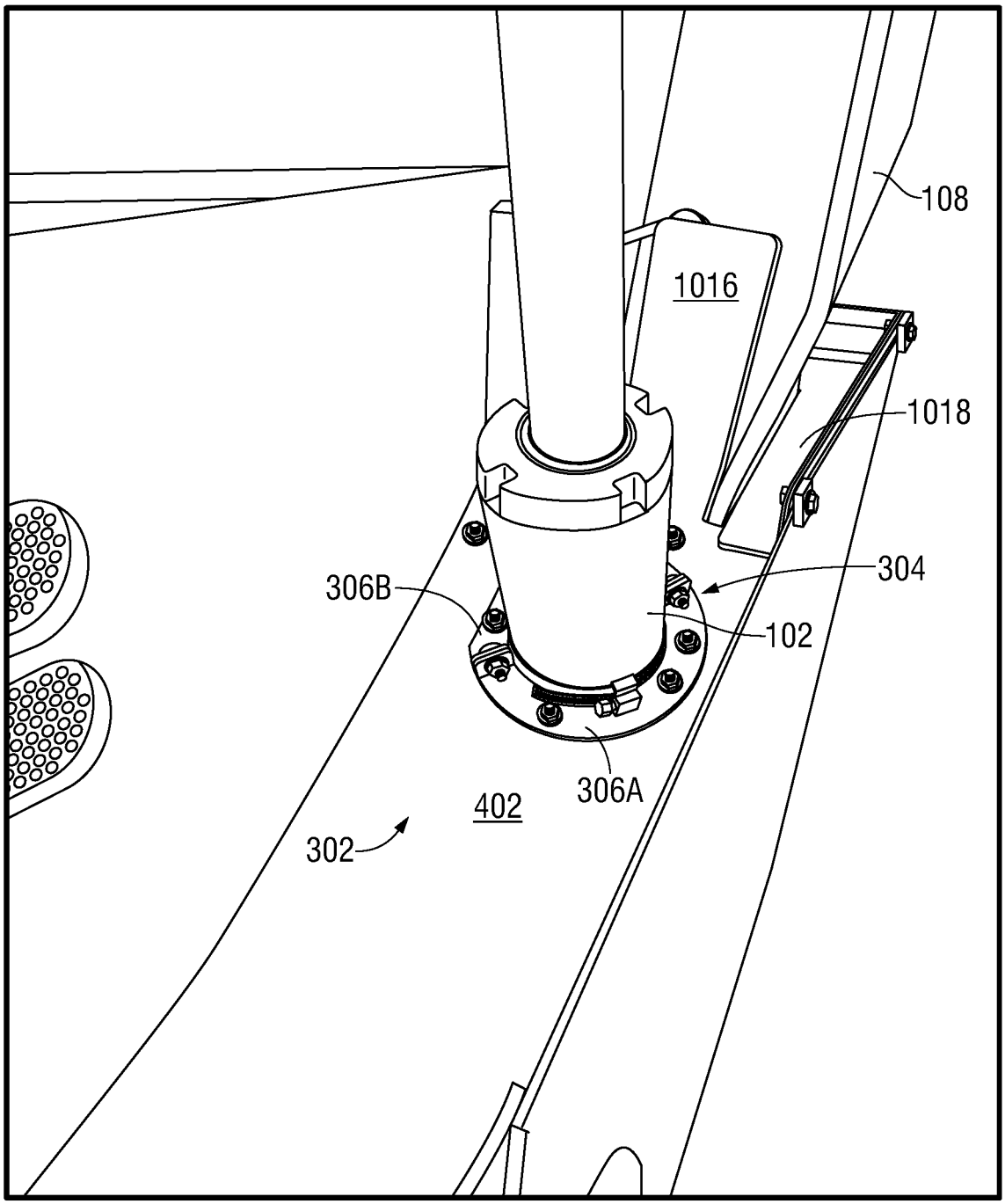
FIG. 8 shows a portion of the debris guard assembly in front of the hydraulic cylinder.

FIG. 8 shows a portion of the debris shield assembly 302 around the hydraulic cylinder 102 and including a portion 1016 of sheet 402 extending up the front of the linking arm 108 and a portion 1018 of sheet 402 that extends to the side of the linking arm. 108. FIG. 8 shows sheet 402 sandwiched between 602B (not visible) and 306B and 602A (not visible) and 306A.

Figure 9:
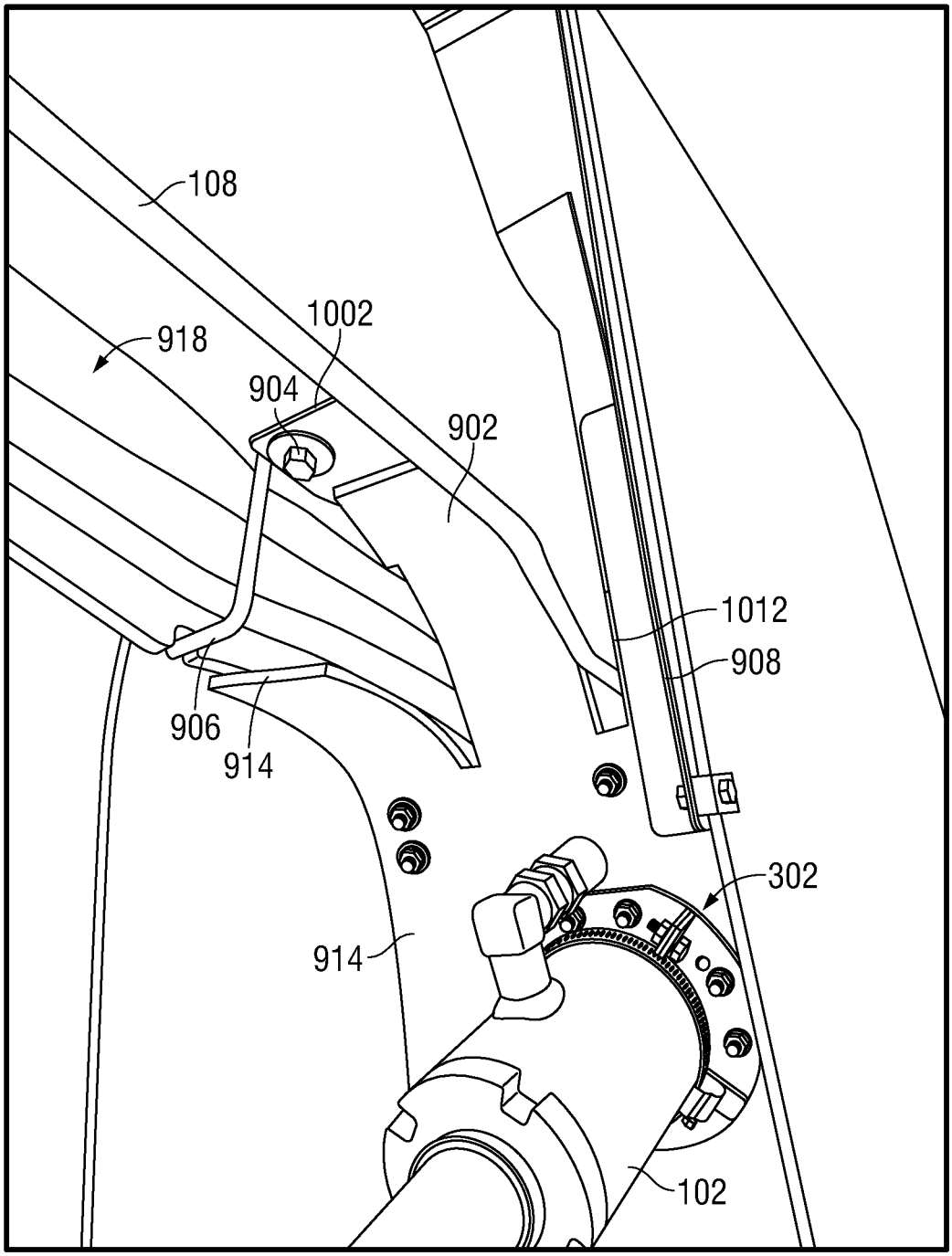
FIG. 9 shows a portion of the debris guard assembly between the hydraulic cylinder and the linking arm.

FIG. 9 shows in more detail the portion of the debris shield assembly 302 between the hydraulic cylinder 102 and the linking arm 108. A rigid support 1002 (show in more detail in FIGS. 11 and 12) includes a hole 1004 (FIG. 11) for attaching via bolt 904 through a cable clamp 906. Rigid support 1002 supports a portion 902 of sheet 402 as it extends up linking arm 108. Cable clamp 906 maintains cables and hydraulic lines 918 against linking arm 108.

Figure 10:
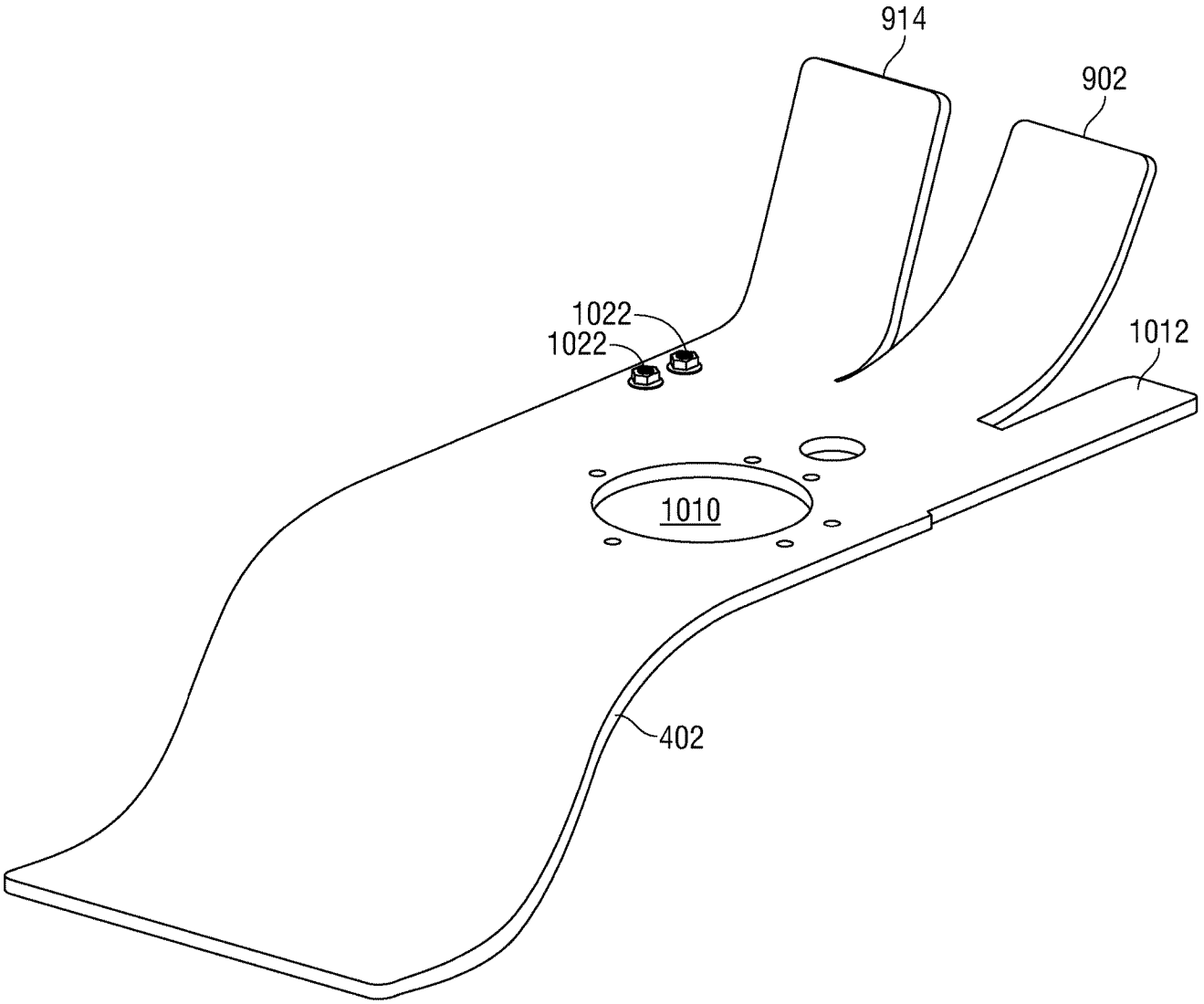
FIG. 10 shows a flexible sheet used in the debris guard assembly.
Figure 11:
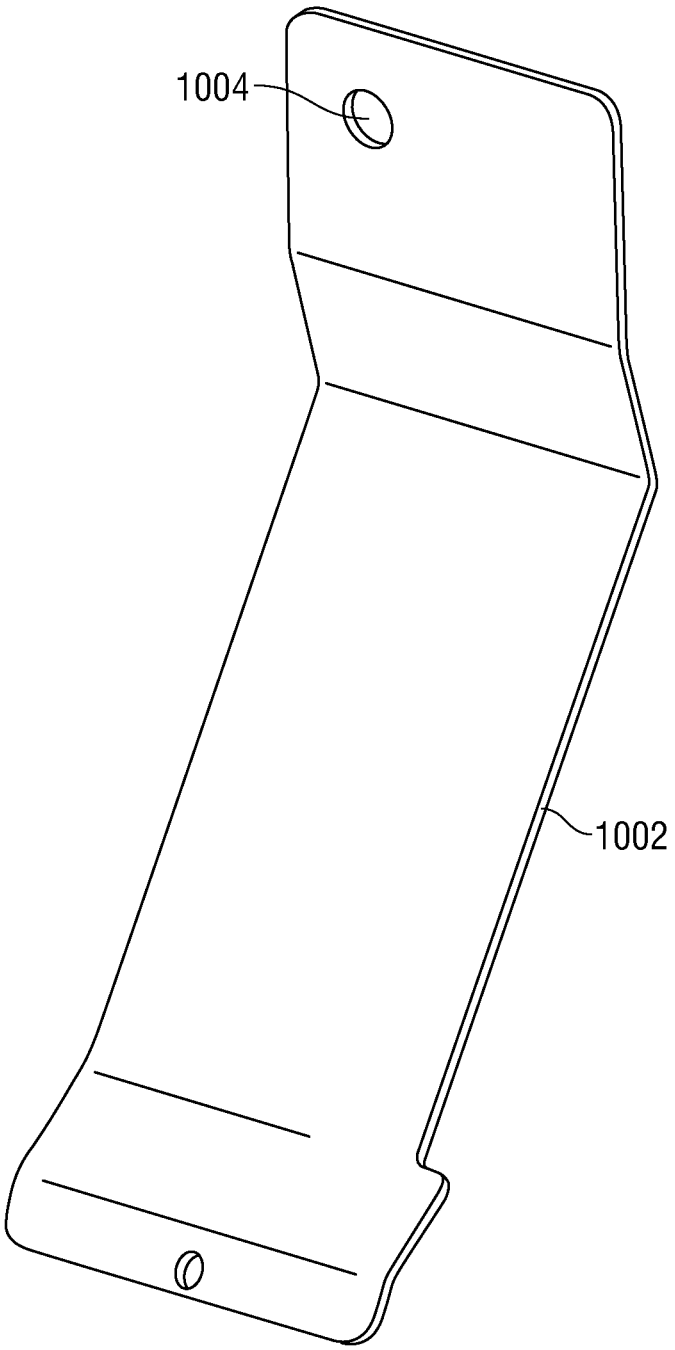
FIG. 11 shows a bracket used in the debris guard assembly.
Figure 12:
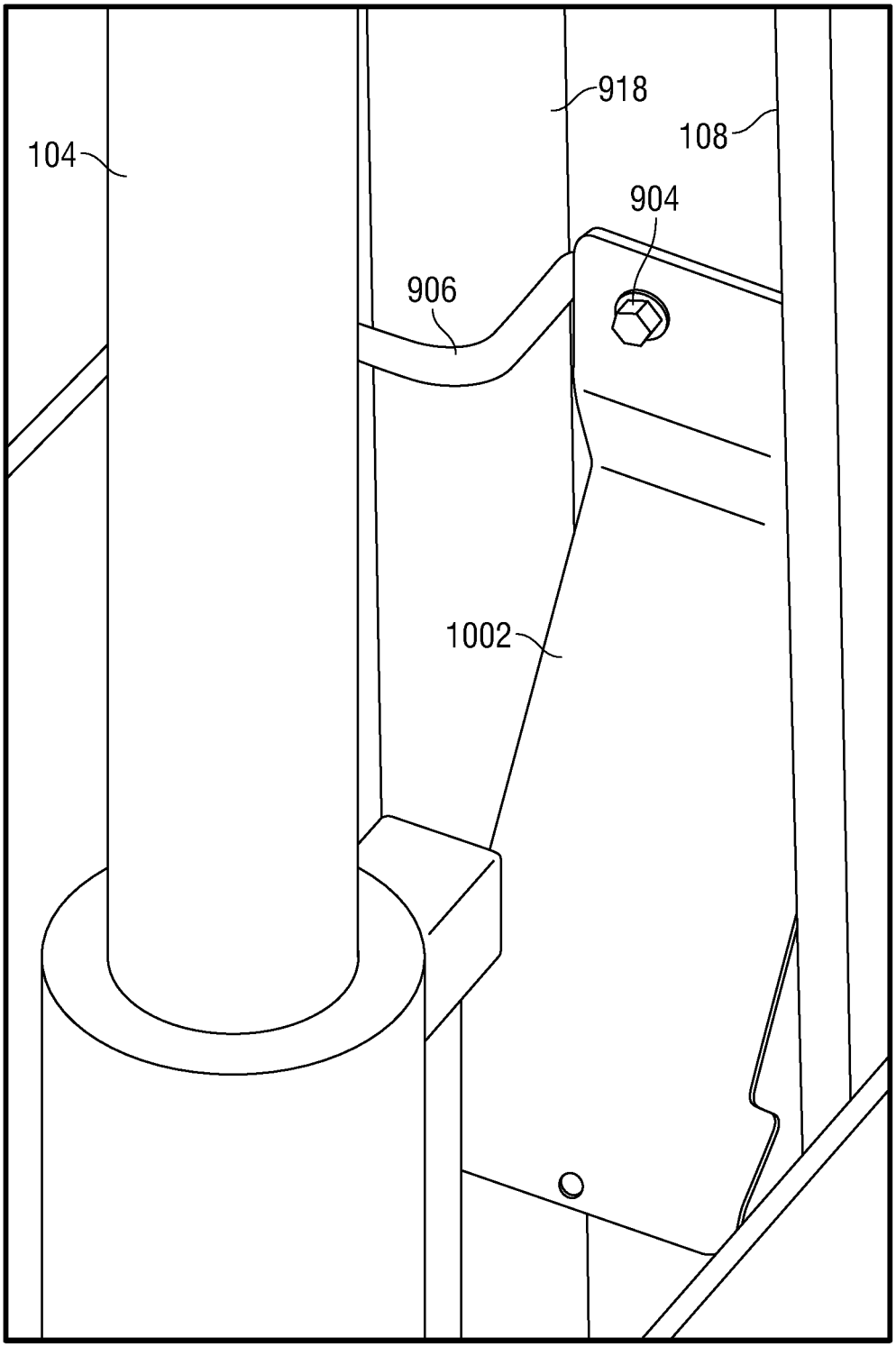
FIG. 12 shows the bracket of FIG. 11 attached to a linking arm.

FIG. 10 shows sheet 402 having a hole 1010 to accommodate cylinder 102 and a first end split into three portions. A first or outer portion 1012 that lies to the side of the linking arm 108 and extends into a groove 1806 (FIG. 19) in seal component 1806, a second or inner portion 914 that extends up against the cables 918 and a center portion 902 that extends up linking arm 108 and against support bracket 1002. Another flap 914 of sheet 402 extends along cables and tubes 918. FIG. 10 also shows two bolts 1022 that are used to assist in holding rubber sheet 402 in place. FIG. 11 shows the rigid support 1002 that supports portion 902 of rubber sheet 402. FIG. 12 shows an enlarged image of the rigid support 1002 attached to linking arm 108 using bolt 904 from the clamp 906 that retains cables and tubes 918.

FIG. 13 shows that rubber sheet 402 is held in place by a bracket 1302 that is attached by bolts 1304 to the loader 100. FIG. 14 show bracket 1302.

Figure 15:
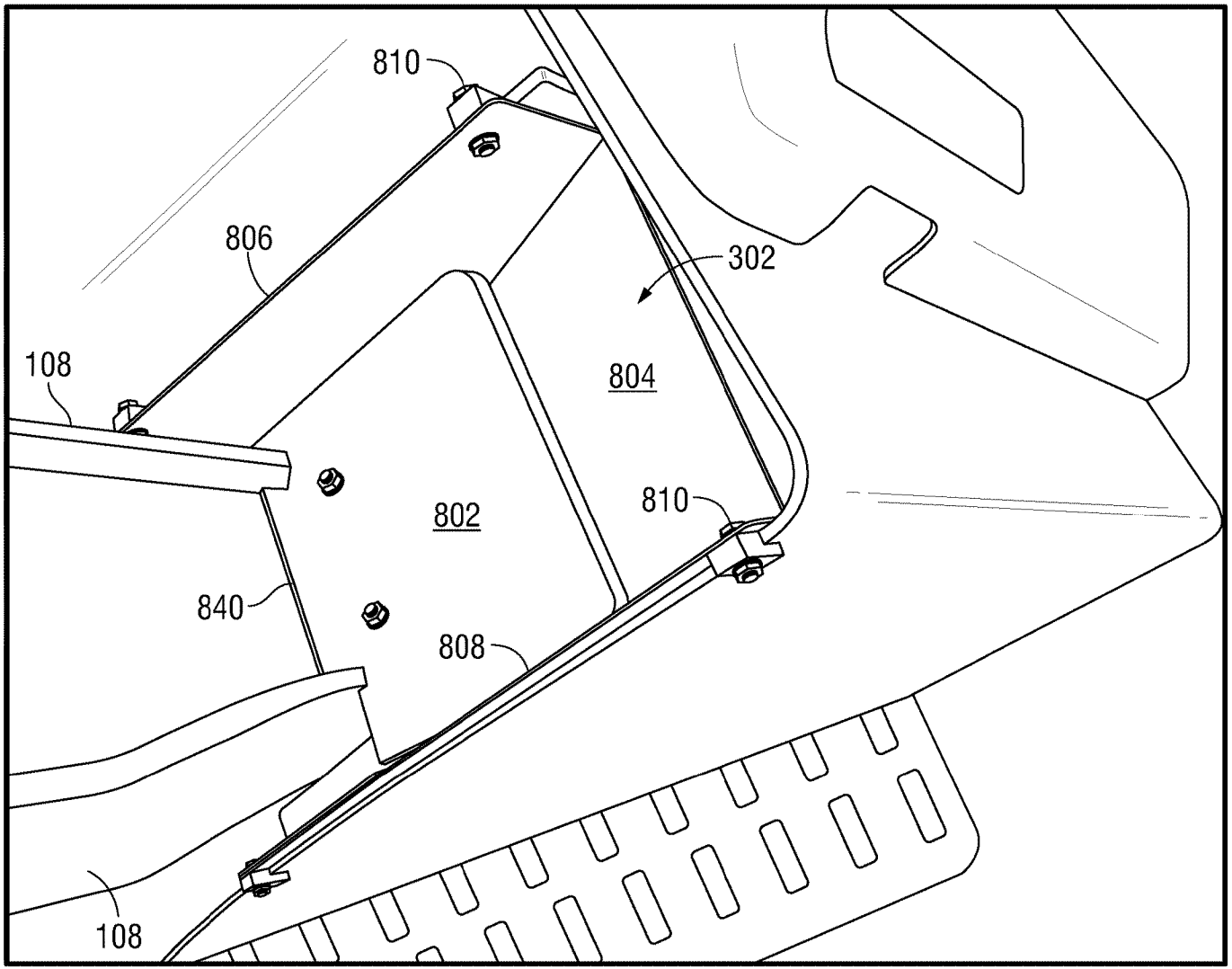
FIG. 15 shows a portion of the debris guard assembly behind the linking arm.
Figure 16:
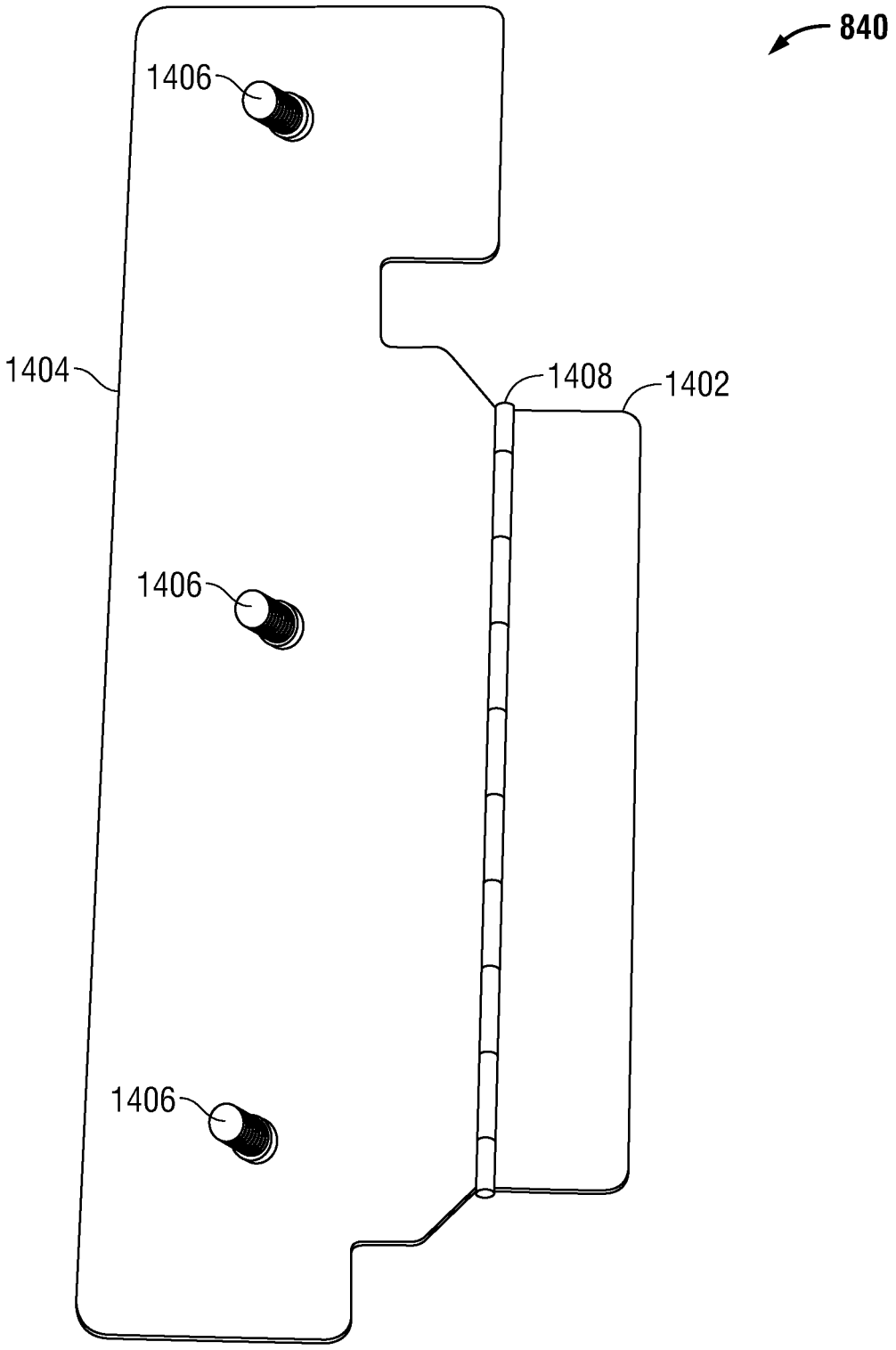
FIG. 16 shows a hinge used to attach a flap to a linking arm.
Figure 17:
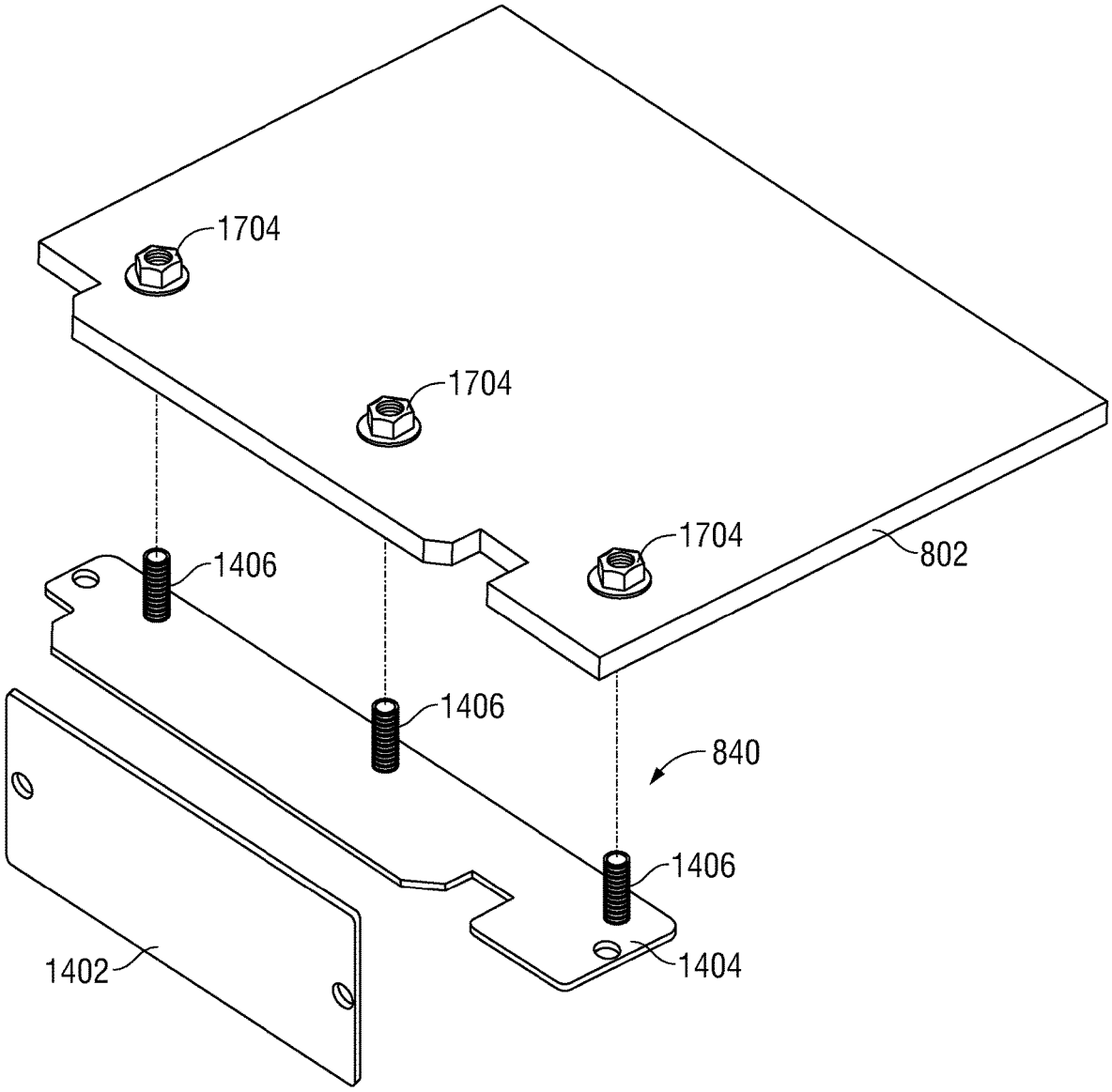
FIG. 17 shows how the flap is attached to the hinge.
Figure 18:
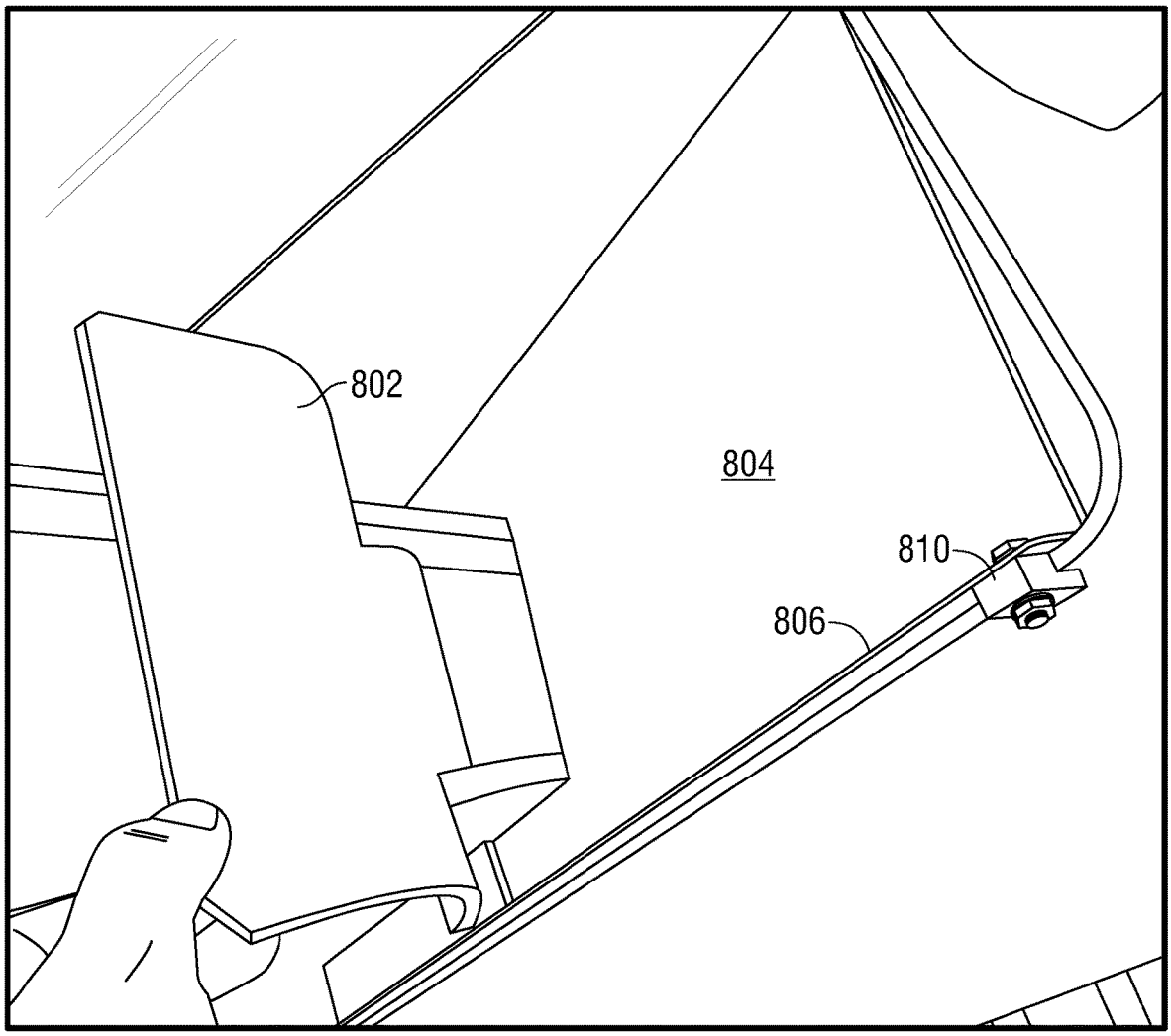
FIG. 18 shows the flap being manually lifted about the hinge.

FIG. 15 shows the portion of the debris guard assembly 302 that is behind the linking arm 108. Debris guard assembly 302 includes a flap 802 fastened to the pivot arm by 108 by a hinge assembly 840. FIG. 16 shows the hinge assembly 840. Hinge assembly 840 includes a flat portion 1402 that attaches to linking arm 108 using, for example, a double sided sticky tape such as 3M VHB tape or an adhesive. Hinge assembly 840 also includes a studded side 1404 including studs 1406 that extend through corresponding holes in flap 802 to attach flap 802 to studded side 1404. Flap 802 is attached to hinge assembly as shown in FIG. 17. A hinge 1408 (FIG. 16) between flat side 1402 and studded side 1404 allows flap 802 to pivot at the hinge as linking arm 108 moves. FIG. 16 shows the hinge assembly 840. FIG. 17 shows how the flap 802 is attached to hinge assembly 840 using nuts 1704 onto studs 1406. FIG. 18 shows flap 802 being manually lifted to illustrate its movement.

Figure 19:
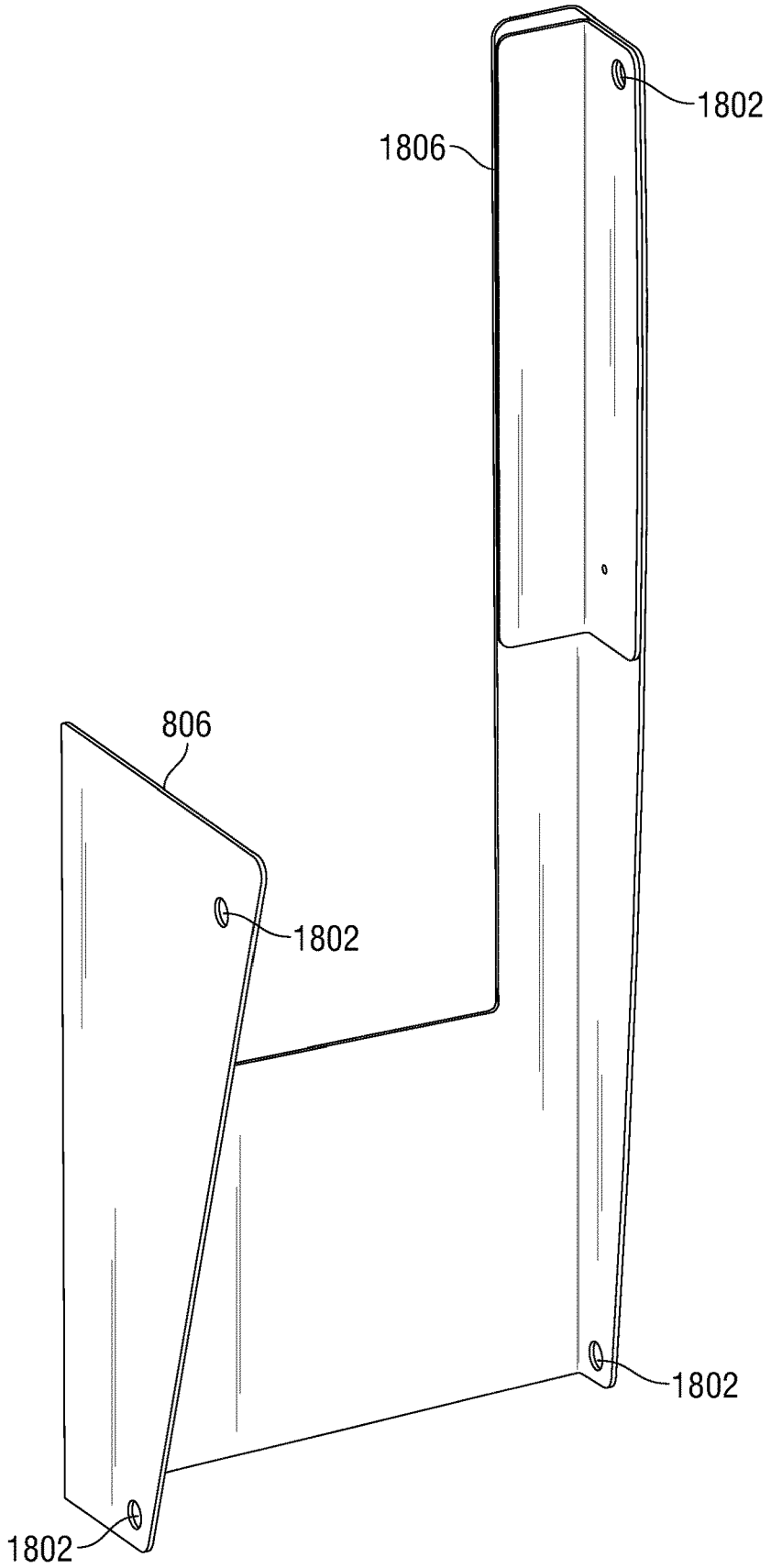
FIG. 19 shows a seal component.
Figure 20A:
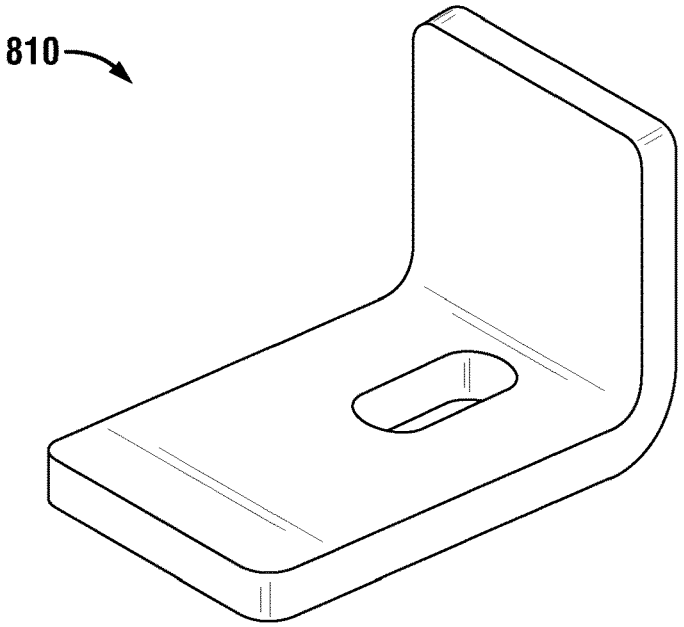
FIG. 20 shows angle clamps used to attach the seal component of FIG. 19 to the loader.
Figure 20B:
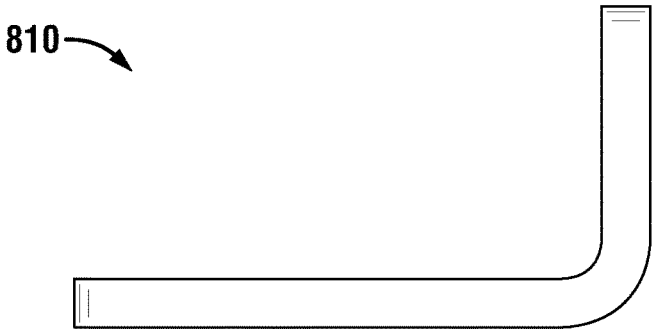
Figure 20C:
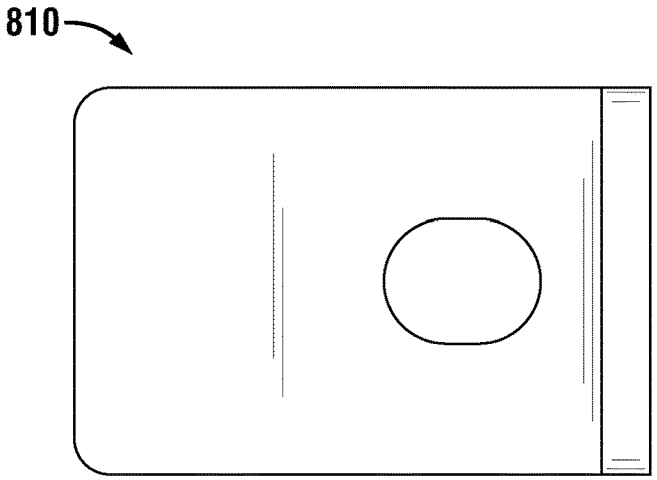
Figure 21:
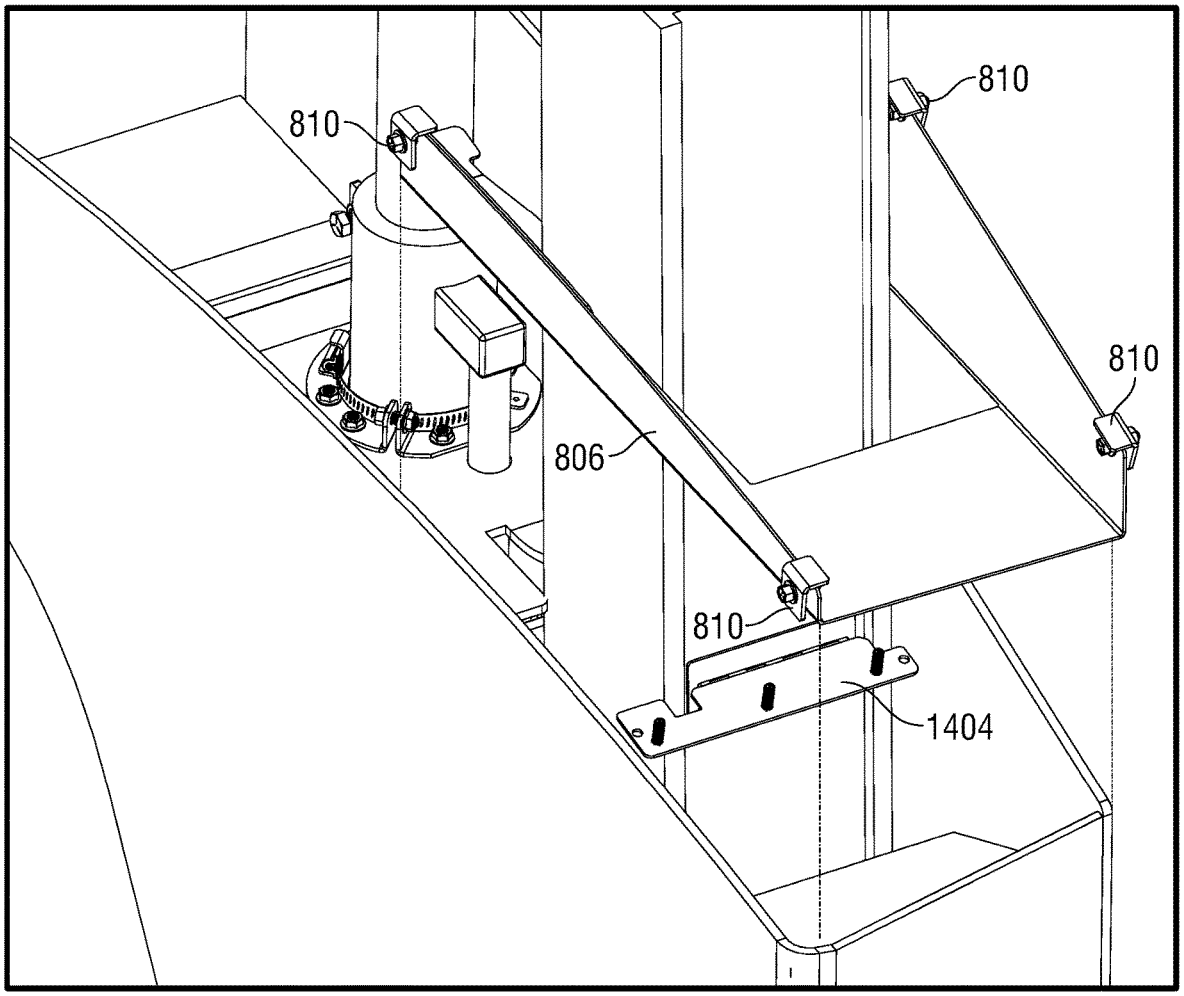
FIG. 21 shows how the seal component of FIG. 19 uses the clamps of FIG. 20 to attach to the loader.

Seal component 806 clamps to the loader by means of bolts and angle clamps 810, shown in FIGS. 15 and 21 and includes a flat portion 804 that hinged flap 802 rests upon, with hinged flap 802 free to slide across the flat portion 804 as linking arm 108 pivots forward and backward. FIG. 19 shows seal component 806, which includes holes 1802 through which bolts attached seal component 806 to the loader. Slot 1806 in seal component 806 accepts portion 1012 of rubber sheet 402. FIG. 20 shows an angle clamp 810, four of which are attached to seal component 806 as shown in FIG. 21.

Figure 22:
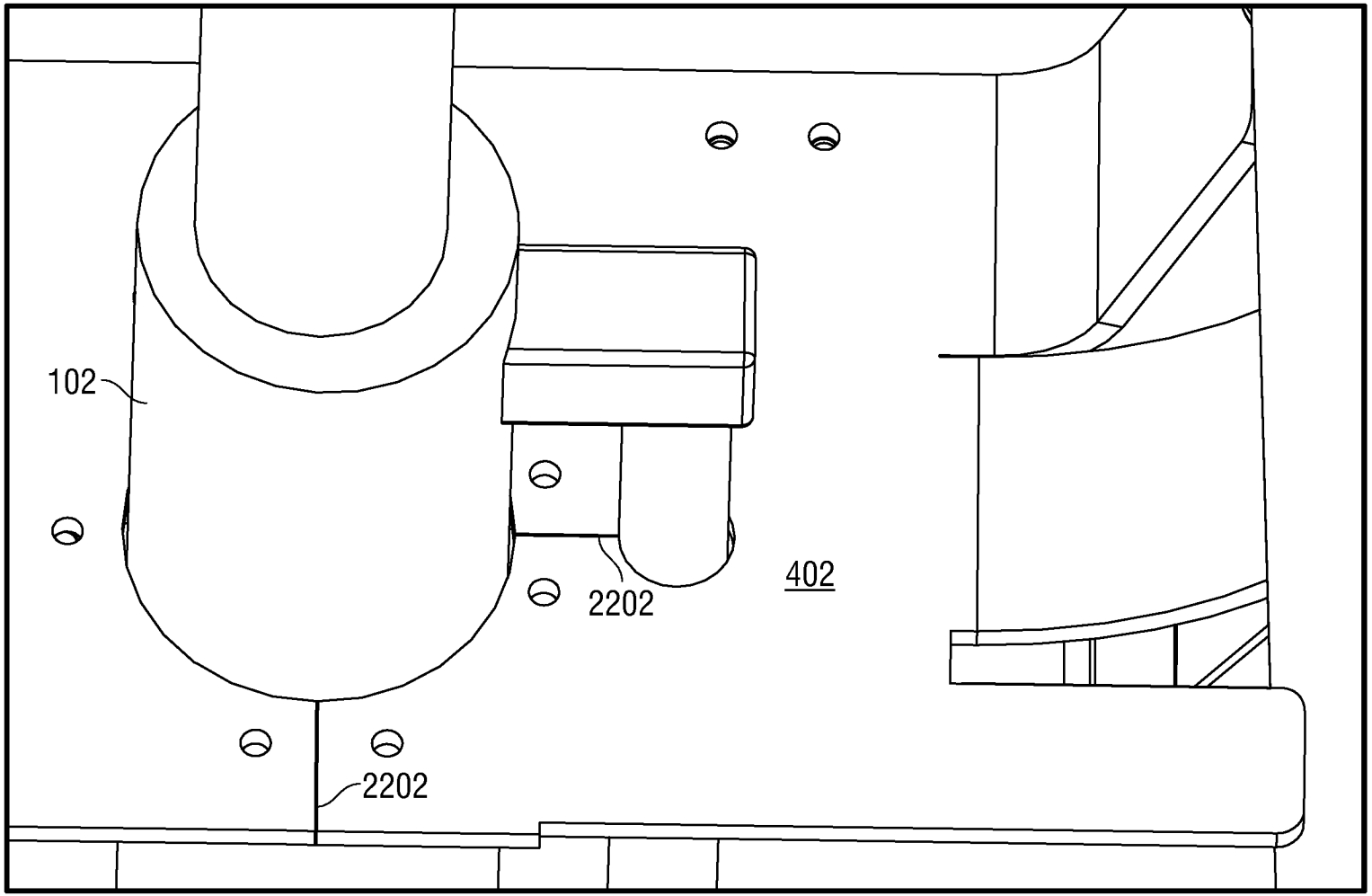
FIG. 22 shows cuts in the sheet to allow the sheet to be mounted around the hydraulic cylinder.

FIG. 22 shows cuts 2202 that can be made in sheet 402 in order to seat sheet 42 around cylinder 102.

Figure 23:
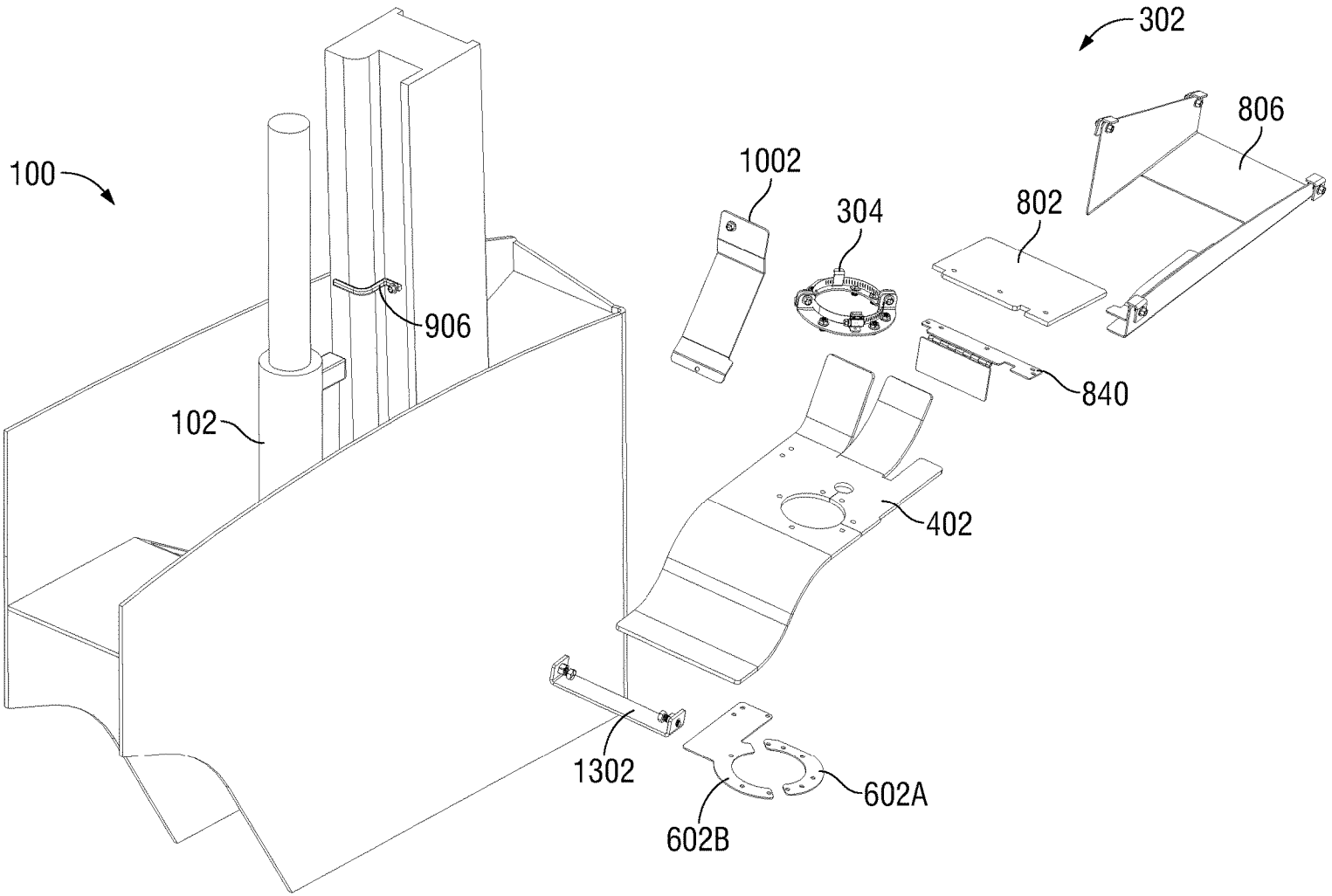
FIG. 23 is an exploded view of the debris guard assembly.

FIG. 23 shows an exploded view of some of the components of debris guard assembly 302.

Some embodiments may seal only around the hydraulic cylinder, while some embodiments may seal only around the pivot arm, while other embodiments seal around both. The seal components and assemblies will be varied when applied to different models of loader.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A debris guard apparatus for preventing debris from entering gaps around a hydraulic cylinder and around a linking arm of a loader, the hydraulic cylinder extending through a first gap and the linking arm extending through a second gap, comprising:

a first seal assembly portion for sealing a portion of the first gap around the hydraulic cylinder of the loader, including:

an elastomeric sheet;

a multi-part metal ring that includes at least one lower portion and at least one upper portion, the upper and lower portions adapted to surround the hydraulic cylinder and trap the elastomeric sheet between the upper and lower portions to prevent debris from entering the portion of the first gap around the hydraulic cylinder; and a rigid support attached to the linking arm to provide support for a portion of the elastomeric sheet that extends up the linking arm;

the first seal assembly portion configured to prevent debris from entering the first gap around the hydraulic cylinder;

a second seal assembly portion for sealing a portion of the second gap behind the linking arm of the loader, the second seal assembly including:

a support attached to the loader in back of the linking arm, the support including a flat region;

a hinge assembly attached to the linking arm on a side opposite to the hydraulic cylinder; and a flap attached to the hinge assembly and lying on the flat region of the support, such that when the linking arm pivots, the flap can rotate around a hinge axis and can move along the support, thereby preventing debris from entering the second gap;

wherein the debris guard apparatus permits movement of the hydraulic cylinder and the linking arm while preventing debris from entering around the hydraulic cylinder and the linking arm.

2. The debris guard apparatus of claim 1 in which one end of the elastomeric sheet is split into an inner portion, a center portion, and an outer portion, the center portion extending up the linking arm.

3. The debris guard apparatus of claim 2 in which the inner portion rests against secured cables and the outer portion is supported in a groove of a support attached to the loader.

4. The debris guard apparatus of claim 2 further comprising a bracket positioned to attach the end of the elastomeric sheet opposite the end that is split to the linking arm.

5. The debris guard apparatus of claim 1 in which the hinge assembly is attached to the linking arm by an adhesive.

6. The debris guard apparatus of claim 1 in which the multi-part metal ring includes two lower portions and two upper portions, each of the upper portions including a lug at each end, the two upper portions being attached to each other by bolts through the lugs.

7. The debris guard apparatus of claim 6 in which each of the lower portions includes multiple studs, the stud positions corresponding to the positions of holes in the two upper portions.

8. The debris guard apparatus of claim 1 in which the elastomeric sheet comprises a rubber sheet.

9. The debris guard apparatus of claim 1 in which the elastomeric sheet includes a slit to facilitate seating the elastomeric sheet around the hydraulic cylinder.

10. A method for preventing debris from entering gaps around a linking arm of a loader, the linking arm extending through a second gap, comprising:

providing a debris guard apparatus in accordance with claim 1; and installing the debris guard apparatus onto the loader.

11. A debris guard apparatus for preventing debris from entering gaps around a hydraulic cylinder and a linking arm of a loader, the hydraulic cylinder extending through a first gap and the linking arm extending through a second gap, comprising:

an elastomeric sheet;

a ring that attaches the elastomeric sheet to the hydraulic cylinder, the elastomeric sheet preventing debris from entering the first gap around the hydraulic cylinder, the elastomeric sheet free to move relative to the loader as the hydraulic cylinder pivots during operation; and two overlapping seal portions behind the linking arm, a first portion moving with the linking arm and a second portion fixed to the loader, the first and second portions covering the second gap;

wherein the debris guard apparatus permits movement of the hydraulic cylinder and the linking arm while preventing debris from entering the first and second gaps around the hydraulic cylinder and around the linking arm.

12. A method for preventing debris from entering a first gap around a hydraulic cylinder of a loader and a second gap around a linking arm of the loader, comprising:

providing a first seal assembly portion for sealing a portion of the first gap, the first seal assembly portion including:

an elastomeric sheet;

a multi-part metal ring that includes at least one lower portion and at least one upper portion, the upper and lower portions adapted to surround the hydraulic cylinder and trap the elastomeric sheet between the upper and lower portions to prevent debris from entering the first gap around the hydraulic cylinder; and a rigid support attached to the linking arm to provide support for a portion of the elastomeric sheet that extends up the linking arm;

the first seal assembly portion configured to prevent debris from entering the first gap around the hydraulic cylinder;

providing a second seal assembly portion for sealing a portion of the second gap behind the linking arm of the loader, the second seal assembly portion including:

a support attached to the loader in back of the linking arm, the support including a flat region;

a hinge assembly attached to the linking arm on the side opposite to the hydraulic cylinder; and a flap attached to the hinge assembly and lying on the flat region of the support, such that when the linking arm pivots, the flap can rotate around the hinge axis and can move along the support, thereby preventing debris from entering the second gap, attaching the first seal assembly portion to the loader; and attaching the second seal assembly portion to the loader;

wherein the debris guard apparatus permits movement of the hydraulic cylinder and the linking arm while preventing debris from entering around the hydraulic cylinder and the linking arm.

* * * * *